United States Patent [19]

Schuh

[11] 3,991,824

[45] Nov. 16, 1976

[54] OFFSHORE WELL DRILLING, COMPLETION AND PRODUCTION

[75] Inventor: Frank J. Schuh, Dallas, Tex.

[73] Assignee: Atlantic Richfield Company, Los Angeles, Calif.

[22] Filed: Nov. 20, 1975

[21] Appl. No.: 633,581

[52] U.S. Cl. ..... 166/.5; 61/86

[51] Int. Cl.[2] ..... E21B 7/12

[58] Field of Search ..... 175/7; 166/.5, .6; 61/46, 46.5, 53, 53.5, 54

[56] References Cited

UNITED STATES PATENTS

| | | | |
|---|---|---|---|
| 2,512,783 | 6/1950 | Tucker | 175/7 X |
| 2,909,901 | 10/1959 | Suderow | 61/46.5 |
| 2,938,353 | 5/1960 | Vorenkamp | 61/46.5 |
| 3,196,958 | 7/1965 | Travers et al. | 166/.5 X |
| 3,202,217 | 8/1965 | Watts et al. | 175/5 X |
| 3,221,506 | 12/1965 | Stratton et al. | 175/7 |
| 3,605,414 | 9/1971 | Westmorland, Jr. | 61/46 |
| 3,782,460 | 1/1974 | Skinner | 175/7 X |
| 3,885,623 | 5/1975 | Watkins et al. | 175/7 X |

*Primary Examiner*—Ernest R. Purser
*Assistant Examiner*—Richard E. Favreau
*Attorney, Agent, or Firm*—Roderick W. MacDonald

[57] ABSTRACT

A method and apparatus useful in the drilling, completion and production of offshore wells such as oil and gas wells wherein the surface layer of the floor of the body of water in which the well is to be located is a soft flowable material. A well conductor pipe means is employed to extend essentially through the soft flowable floor layer. The conductor means carries means for varying the buoyancy of the well conductor so that the well conductor can be floated in the soft, flowable floor layer and well operations carried on through the interior of the well conductor, the well conductor preventing the soft flowable floor layer from flowing into the wellbore.

14 Claims, 4 Drawing Figures

OFFSHORE WELL DRILLING, COMPLETION AND PRODUCTION

BACKGROUND OF THE INVENTION

Heretofore in drilling offshore wells the initial portion of the wellbore nearest the ocean floor had set therein a conductor pipe through which further well operations were carried out. Generally this conductor is installed in one of two methods depending on the bottom soils. If the soils are soft (normally compacted) the conductor can be jetted into the sea floor to a depth that will provide adequate support. If the soils are hard (overly compacted and too hard to jet) the conductor hole must be drilled. Often, in the latter situation the conductor pipe has connected to the upper end thereof a landing base which was designed to rest on the surface of the floor of the body of water, e.g., the ocean floor, to support the conductor. Such a combination of well conductor and landing base is fully and completely disclosed in U.S. Pat. No. 3,143,172, the disclosure of which is incorporated herein by reference.

In some areas of the world, such as where the bottom portion of the conductor hole must be drilled, there is at least a top layer of the floor on which the landing base is to rest is so soft and flowable that it is a semi-fluid material and the landing bases of the prior art simply sink into this floor layer just as they sink in the water above the floor layer. Also in such situations additional axial support at the mud line can be necessary. Thus, in these situations the prior art landing bases provide essentially no support for the conductor. In these situations proper setting of the well conductor is quite important in order to keep the flowable floor layer from flowing into any wellbore drilled. Otherwise no headway is made with the wellbore into a more competent formation which will not flow into the wellbore since, in the absence of the well conductor, the flowable layer fills in the wellbore as fast as it is drilled.

Accordingly, where the floor through which a wellbore is to pass is soft and flowable, it is highly desirable to have apparatus and a method which will allow for the positive supporting of well conductor in the soft flowable floor layer.

SUMMARY OF THE INVENTION

According to this invention, apparatus is provided for use in drilling and later the completion and production of an offshore well in a body of water over a soft, flowable floor comprising well conductor pipe means and means carried by said well conductor for varying the buoyancy thereof so that the well conductor can be made to float in said soft, flowable floor.

There is also provided according to this invention a method for drilling an offshore well wherein the above assembly of well conductor pipe means and means for varying the buoyancy thereof is provided, the density of this assembly is adjusted to be between the density of the flowable floor layer and the density of the water in the body of water above the floor layer, thereafter this assembly is floated in the floor layer itself and well operations continued through the thus floated well conductor.

Accordingly, it is an object of this invention to provide a new and improved method and apparatus for drilling, completing and producing an offshore well. It is another object to provide a new and improved method and apparatus for supporting a well conductor in an offshore well. It is another object to provide a new and improved method and apparatus for landing and supporting surface conductor pipe for an offshore well.

Other aspects, objects and advantages of this invention will be apparent to those skilled in the art from this disclosure and the appended claims.

DETAILED DESCRIPTION OF THE INVENTION

In FIG. 1 there is shown a cross section of apparatus within this invention.

Figure 1:
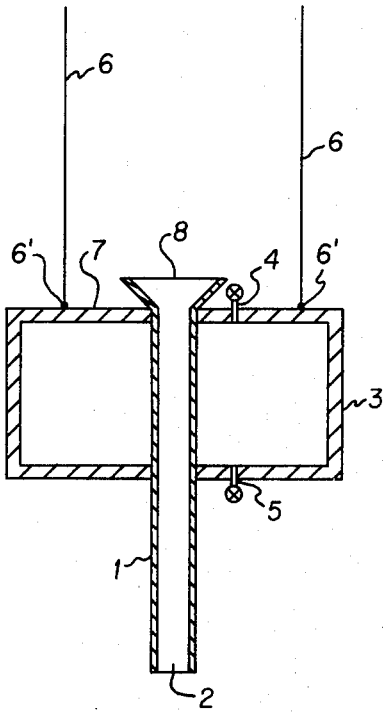

More specifically, FIG. 1 shows well conductor pipe means 1 and its longitudinally extending open interior 2. The upper end of well conductor 1 is encompassed by a chamber 3 which carries upper and lower valve means 4 and 5, respectively. Guide line means 6 are connected to the chamber at 6' and to the floating barge or drilling vessel (not shown) at the surface of the body of water for controlling the assembly composed of well conductor 1 and chamber 3 as it is lowered through the water towards the floor layer in which conductor 1 is to be set.

Thus, conductor 1 defines an opening from the top surface 7 of chamber 3 through chamber 3 so that other well operations such as drilling, completion, production and the like can be carried out from the surface of the water through this opening and through conductor 1 on down into the wellbore. Funnel means 8 is provided on the upper surface 7 of chamber 3 about this opening to facilitate the entry of apparatus being lowered from the drill ship at the surface of the water into the opening, through conductor 1, and on down into the wellbore.

The apparatus of FIG. 1 shows chamber 3 to be an enclosed hollow chamber.

In accordance with this invention, weighting agent will either be added to or removed from chamber 3 to adjust the density of the assembly of conductor 1 and chamber 3 so that the assembly will float in the soft, flowable floor layer into which the assembly is lowered. The weighting agent can be any material desired solid, liquid, gas, or combinations of two or more thereof and the like. Valve means 4 and 5 are provided to facilitate the entry of weighting agents such as liquid by way of valve 4 and the removal of weighting agent by way of valve 5 because the density of the assembly will have to be varied from geographical location to geographical location.

Figure 2:
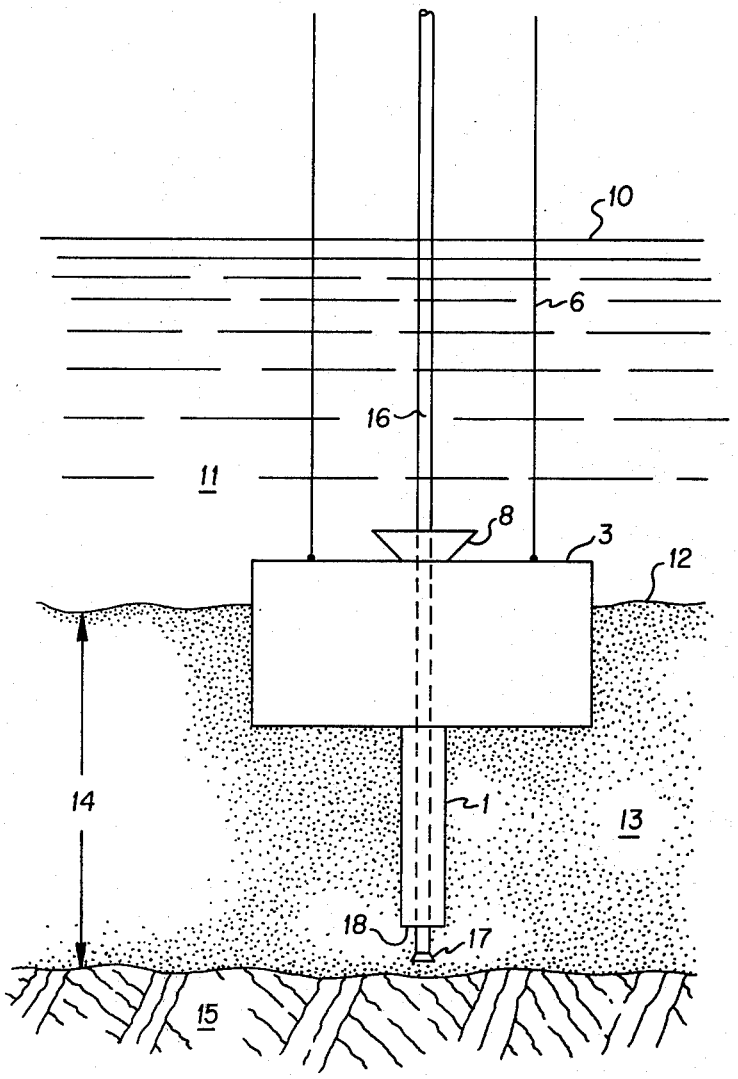
FIG. 2 shows the apparatus of FIG. 1 after it has been floated in a surface layer of the floor of a body of water.

FIG. 2 shows the water surface 10, the body of water 11 through which the assembly of this invention has been lowered, the surface of the soft, flowable floor layer 12, and soft, flowable floor layer 13 which extends for a finite thickness 14 down to a more competent, i.e., hard, formation 15. A wellbore drilled in soft, flowable layer 13 without the use of conductor pipe 1 will simply fill in again with mud or whatever layer 13 is composed of whereas a wellbore drilled in competent formation 15 will maintain the wellbore hole like a wellbore drilled in rock, and will not automatically fill in that hole as would be the case with the mud of layer 13. Thus, conductor 1 in layer 13 maintains an open hole through layer 13 so that drilling operations can be carried on into competent formation 15. This is shown by drill pipe string 16 carrying bit 17 at the lower end thereof.

Thus, in accordance with this invention, the density of the assembly of conductor 1 and chamber 3 is adjusted by adding weighting agent to or removing weighting agent from the hollow interior of chamber 3 until the density of that assembly is intermediate the density of water 11 and the density of flowable layer 13 so that the assembly will float in layer 13. This is why chamber 3 is shown to be substantially immersed in layer 13. Chamber 3 is actually floating in layer 13 much like it would float in water 11 the assembly's density adjusted so as to be lighter than water 11. This way chamber 3 and conductor 1 does not continually sink into layer 13 as would prior art landing bases which are too heavy and have no provision for adjustment of the buoyancy of its well conductor-landing base assembly.

The length of conductor 1 should be sized to the given situation so that the combined length of conductor plus the length of chamber 3 that sinks into layer 13 is no greater than thickness 14 of layer 13. This is so the bottom end 18 of conductor 1 will not rest on competent formation 15 thereby causing conductor 1 to support the weight of the conductor and chamber 3 and let the assembly tip over. Rather, it is preferred that conductor 1 extend through a substantial portion of layer 13 but not exceed thickness 14. It is even more preferable that the lower end 18 of conductor 1 come quite close to the interface between layers 13 and 15 to prevent the flow of substantial amounts of material from 13 into the wellbore as it passes into more competent layer 15.

Figure 3:
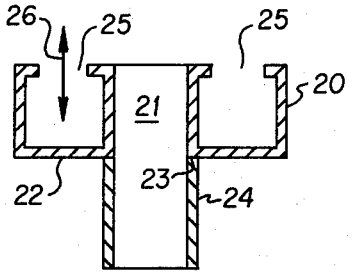
FIG. 3 shows a cross section of yet other apparatus within this invention.

FIG. 3 shows a closed hollow annular chamber 20 which has an opening 21 therethrough and which has connected to the lower surface 22 thereof at interface 23 a well conductor 24. That is to say well conductor 24 in FIG. 3 does not extend into opening 21 and therefore does not provide one of the surfaces of chamber 20 as shown for conductor 1 in FIG. 1. Also, chamber 20 is shown to have an opening 25 which is not valved and therefore chamber 20 is not a liquid-tight chamber as chamber 3 could be. Opening 25 can be used to add or remove weighting agent therefrom as shown by arrow 26, the weighting agent in such a situation preferably being a solid-type material which will not float or wash from the interior of chamber 20 through opening 25 when the chamber is in place in the body of water.

Figure 4:
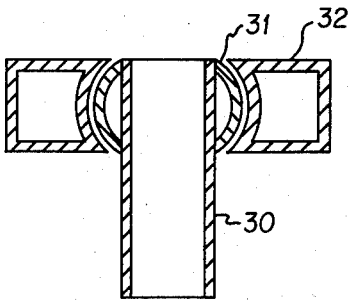
FIG. 4 shows still other apparatus within this invention wherein the means for varying the buoyancy of the conductor pipe is movable relative to the conductor pipe itself.

Note that in FIGS. 1 and 3 the conductor has been shown to be rigidly connected to the float chamber. In FIG. 4 conductor 30 is shown to have a rounded annular member 31 around its upper end. Chamber 32 is shown to have a mating rounded surface adjacent to member 31 so that chamber 32 can, under the forces present in the body of water and/or the soft flowable layer in which it is to float, rotate relative to conductor 30 thereby allowing chamber 32 to move while allowing conductor 30 to remain in an essentially vertical orientation.

When the chamber contains liquid, final adjustment of its buoyancy while it is floating in the ocean floor could be made by adding a gas such as air to the interior of the chamber. This could also be done to equalize the pressure between the inside and outside of the chamber as it floats in its operating position in the ocean floor or at least to reduce the pressure differential on the chamber so that it is insignificant and will not affect the life of the chamber. Note also that buoyancy in accordance with this invention could, if desired, be used for surface support and more than just the conductor pipe, for example, for supporting other pipe and/or tools running through said conductor.

Example

Using apparatus as shown in FIG. 1, except that no valve 5 is present, hollow, liquid-tight chamber 3 is fixed to conventional 42 inch offshore oil well conductor pipe, the length of the well conductor being no greater than the thickness of the flowable floor layer into which the chamber 3-well conductor 1 assembly is to be floated. Water is added to the interior of chamber 3 by way of valve 4 until the density of that asembly is intermediate that of the water and the soft flowable floor layer. For example, if the assembly shown in FIG. 1 in air and empty has a density of 20 pounds per cubic foot, the density of the ocean water through which the assembly is to be lowered is 64 pounds per cubic foot, and the density of the ocean floor mud layer in which the assembly is to be floated is 100 pounds per cubic foot, then if chamber 3 is filled with ocean water the average density of that assembly in air is increased from 20 pounds per cubic foot to about 81.4 pounds per cubic foot, after which the assembly is lowered by way of guide lines 6 through the ocean water to the ocean floor and allowed to sink into mud layer 13 a distance less than the height of chamber 3 but until the assembly was floating on its own. Thereafter drill pipe 16 with bit 17 of FIG. 2 would be lowered through the opening in chamber 3 and through the interior of conductor 1, and the wellbore deepened through competent formation 15 to a desired extent. After deepening into formation 15 conventional 30 inch casing would be set and the annulus between the outside of the 30 inch casing and the inside of the 42 inch conductor 1 would be cemented in a conventional manner, the 30 inch casing being supported by resting on the upper surface 7 of chamber 3 before cementing and while cementing is being carried out.

Reasonable variations and modifications are possible within the scope of this disclosure without departing from the spirit and scope of this invention.

The embodiments of the invention in which an exclusive property or privilege is claimed are defined as follows:

1. Apparatus for use in drilling an offshore well in a body of water over a soft flowable floor comprising a chamber, said chamber being hollow and enclosed in a liquid-tight manner, said chamber carrying means for admitting liquid to its hollow interior to alter the buoyance thereof so said chamber can be made to float in said soft flowable floor and the pressure equalized between the inside and outside of said chamber as it floats in said floor, well conductor pipe means carried by and extending below said chamber, said well conductor pipe means not carrying any landing base below said chamber, said chamber having an opening to provide access for other well apparatus to pass from the top surface of said chamber through said opening and into said well conductor.

2. The apparatus of claim 1 wherein said chamber carries guide line means thereon.

3. The apparatus of claim 1 wherein said chamber carries funnel means on its top surface about said opening.

4. The apparatus of claim 1 wherein said chamber and well conductor are rigidly fixed to one another.

5. The apparatus of claim 1 wherein said chamber and well conductor are fixed to one another so that said chamber can rotate relative to said well conductor.

6. The apparatus of claim 1 wherein said chamber also carries means for removing liquid from its hollow interior.

7. A method for drilling an offshore well in a body of water which has a floor layer that is soft and flowable comprising providing an assembly of well conductor pipe means and means for varying the buoyancy thereof, said well conductor being sized in length to extend through a substantial portion of said flowable floor layer but not to exceed the thickness of said layer, adjusting the density of said assembly to be between the density of said flowable floor layer and the density of the water in said body of water, floating said assembly in said floor layer, and conducting well drilling operations through said well conductor.

8. The method of claim 7 wherein said well conductor is sized in length to extend through a substantial portion of said flowable floor layer but not to exceed the thickness of said layer.

9. The method of claim 7 wherein the density of said assembly is adjusted by adding weight onto or taking weight off of said well conductor.

10. The method of claim 7 wherein the density of said assembly is adjusted by taking liquid into or removing liquid from a hollow chamber carried by said well conductor.

11. The method of claim 7 wherein when said assembly is floating in said floor layer the pressures on the inside and outside of said means for varying the buoyancy of said conductor pipe means are essentially equal.

12. A method for drilling an offshore well wherein the floor of the body of water in which the well is to be located is composed of a soft flowable layer underlain by a more competent formation, said method comprising providing an enclosed hollow chamber having means for admitting liquid into the interior thereof, said chamber having an opening therethrough, providing well conductor pipe means, adjusting the length of said well conductor to be no greater than the thickness of said flowable layer, attaching said well conductor to the lower surface of said chamber so that said opening in said chamber is aligned with the interior of said well conductor, adding liquid to the interior of said chamber until the density of the combination of said chamber and well conductor is intermediate the densities of the water above said flowable layer and said flowable layer itself, floating said chamber and well conductor in said flowable layer, and passing a drill pipe string carrying a bit at the lower end thereof through said opening and well conductor for drilling into said competent formation.

13. The method of claim 12 wherein said chamber also has means for removing liquid therefrom and said density of the combination of said chamber and well conductor is adjusted by adding liquid to or removing liquid from said chamber.

14. The method of claim 12 wherein when said chamber and well conductor are floating in said flowable layer the pressures on the inside and outside of said chamber are essentially equal.

* * * * *

UNITED STATES PATENT OFFICE

CERTIFICATE OF CORRECTION

PATENT NO. : 3,991,824

DATED : November 16, 1976

INVENTOR(S) : Frank J. Schuh

It is certified that error appears in the above-identified patent and that said Letters Patent are hereby corrected as shown below:

Col. 3, line 14, insert after the number "11" the word ---were---.

Col. 5, lines 25 through 28 should be omitted, i.e., entire Claim 8.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*